US005660582A

United States Patent [19]

Terris

[11] Patent Number: 5,660,582

[45] Date of Patent: Aug. 26, 1997

[54] DUAL ROTARY CUTTER BLADE SHARPENER

[76] Inventor: Alta Faye Terris, 4305 Northpointe Way, Pensacola, Fla. 32514-6630

[21] Appl. No.: 558,377

[22] Filed: Nov. 16, 1995

Related U.S. Application Data

[63] Continuation-in-part of Ser. No. 344,877, Nov. 25, 1994, Pat. No. 5,499,943.

[51] Int. Cl.[6] ..... B24B 23/08

[52] U.S. Cl. ..... 451/359; 451/349; 451/549; 451/557; 451/558

[58] Field of Search ..... 451/44, 241, 254, 451/258, 282, 344, 422, 423, 349, 358, 359, 540, 541, 545, 549, 557, 558

[56] References Cited

U.S. PATENT DOCUMENTS

| | | | |
|---|---|---|---|
| 889,830 | 6/1908 | Van Berkel | 451/422 |
| 1,165,342 | 12/1915 | Peterson | 451/422 |
| 1,957,776 | 5/1934 | Gury | 451/422 |
| 2,721,430 | 10/1955 | Green | 451/422 |
| 3,315,452 | 4/1967 | Rossi | 451/423 |
| 3,349,485 | 10/1967 | Bettcher | 451/422 |
| 4,373,302 | 2/1983 | Darby | 451/374 |
| 5,031,363 | 7/1991 | Thiem | 451/344 |

*Primary Examiner*—Timothy V. Eley

*Attorney, Agent, or Firm*—George A. Bode; Daniel E. Maddux

[57] ABSTRACT

This invention is a tool designed to sharpen rotary cutter blades. In a first embodiment, an inside-threaded clamp is screwed down upon the blade, pressing it tightly against a platform from which a threaded shank rises, and holding the blade from turning. When an upper casing containing an inside angled abrasive strip is lowered over the clamp until contact is made against the blade surface, the abrasive strip is brought into contact with the blade edge. When the upper casing is rotated around the tightened clamp, the abrasive acts upon the blade edge and thereby sharpens the edge. A second embodiment is comprised of a blade holder for holding the cutting blade stationary and a ring member with an abrasive strip which fits around the blade holder such that the abrasive strip contacts the edge of the cutting blade. The blade holder comprises detachable male and female members having base portions for securing the cutting blade and handle portions mounted on the base portions for rotating the blade holder relative to the ring member.

22 Claims, 8 Drawing Sheets

FIG. 2
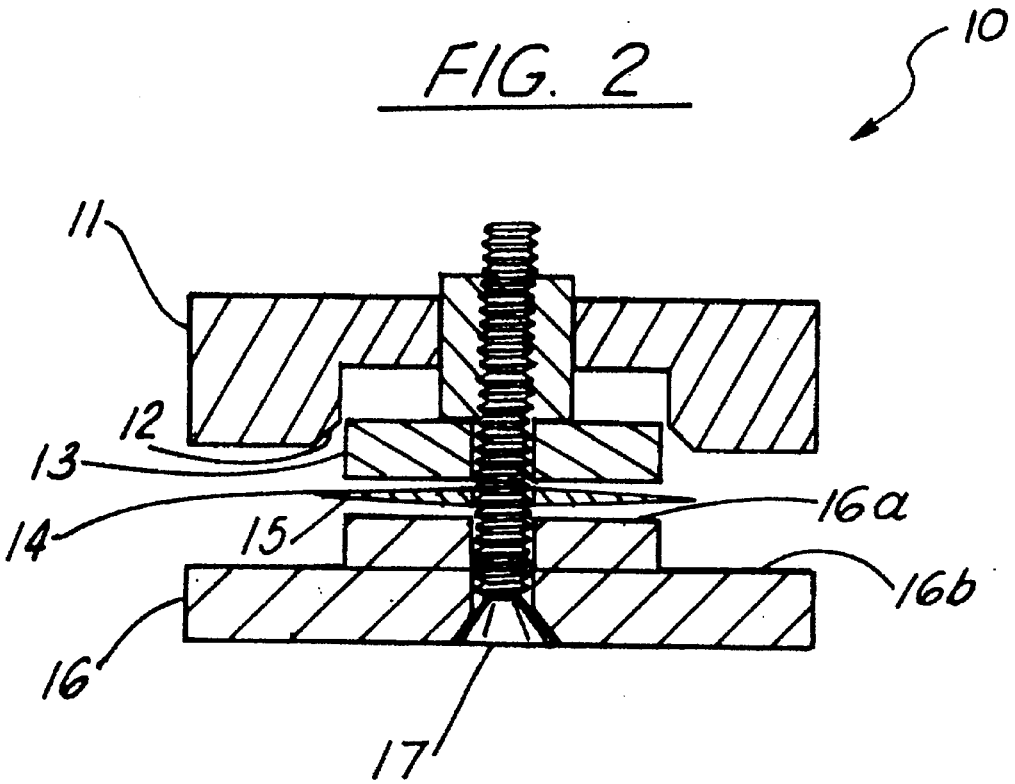
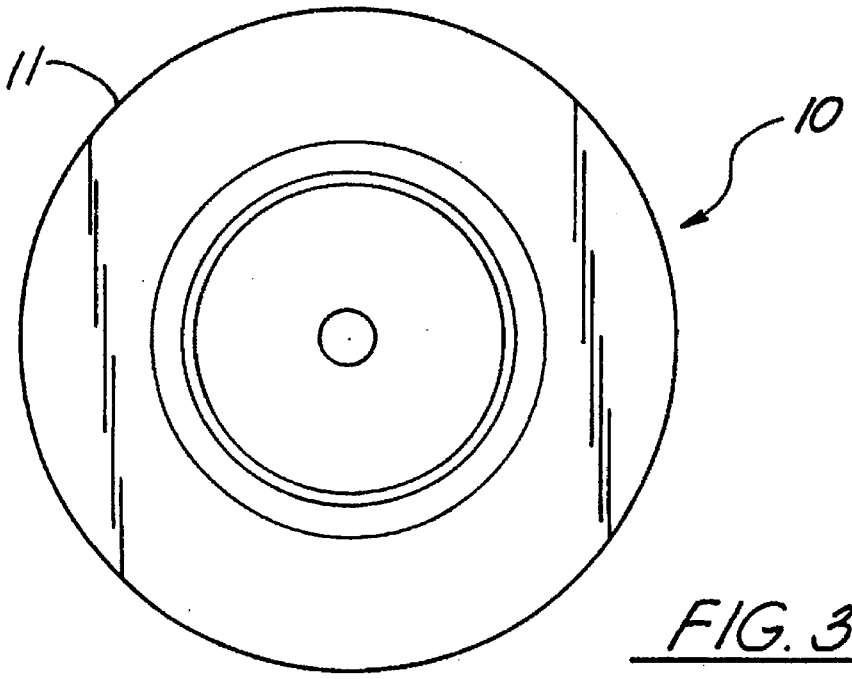
FIG. 3

FIG. 8
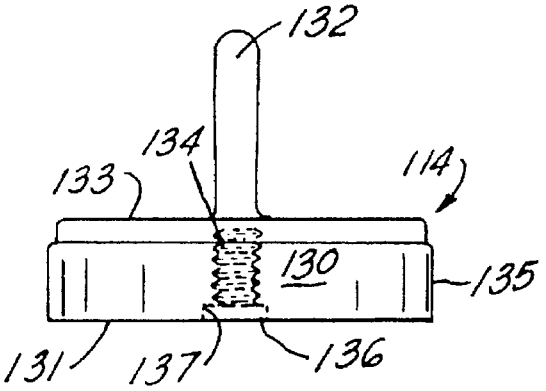
FIG. 11
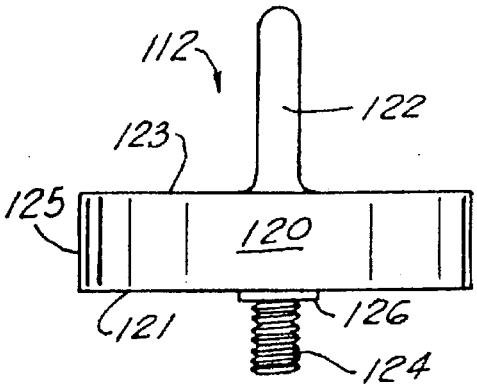
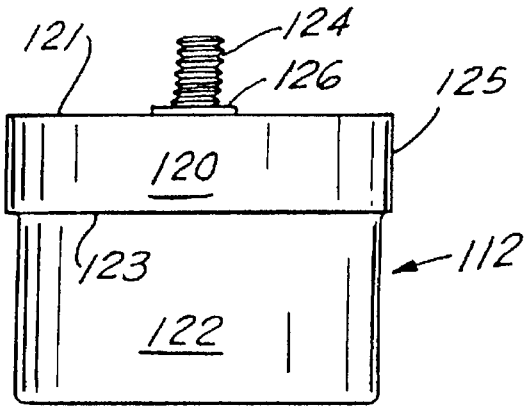
FIG. 9
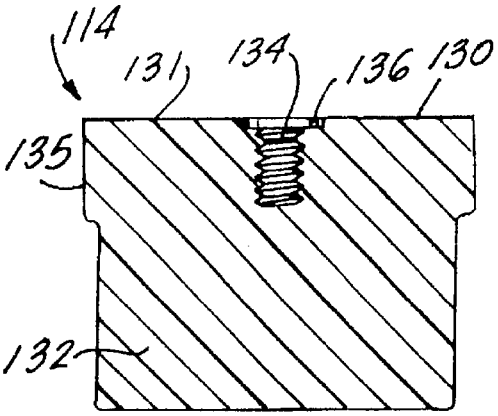
FIG. 12
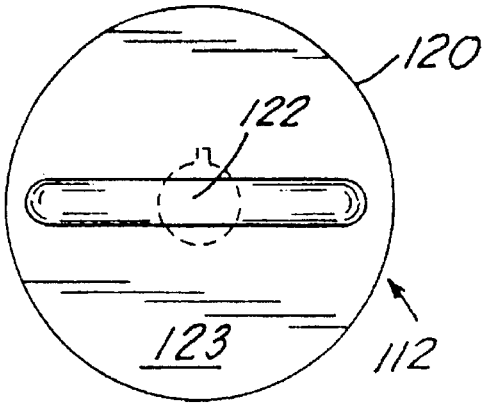
FIG. 10
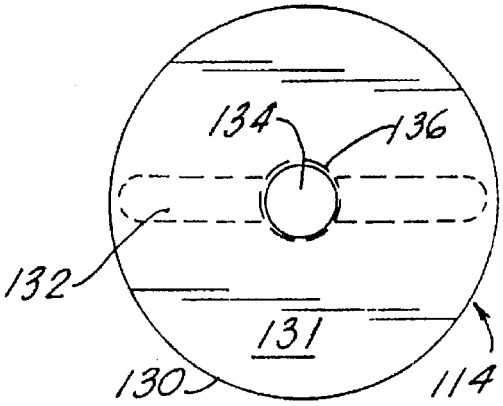
FIG. 13

DUAL ROTARY CUTTER BLADE SHARPENER

This application is a continuation-in-part application of a previous application by the same inventor bearing U.S. Ser. No. 08/344,877 filed Nov. 25, 1994 now U.S. Pat. No. 5,499,943. The entire previous application U.S. Ser. No. 08/344,877 is incorporated herein by reference and is set forth in full below.

BACKGROUND OF THE INVENTION

1. Field of the Invention

The present invention relates to an apparatus for sharpening the circular cutting blade of a rotary cutter tool, particularly a hand-held apparatus for sharpening the circular cutting blade of a rotary cutter tool which provides a blade holder and a ring member having two radial sides with an abrasive strip fixedly attached to each radial side.

2. General Background

Always on the lookout to save money, I searched the market in vain for a method to restore the dulled cutting edge of the blade in the popular rotary cutter most everybody uses for cutting fabric for home sewing. Finding none, I have invented a simple tool to do that very thing. The blades cost in the neighborhood of SIX ($6.00 U.S.) U.S. DOLLARS and this invention will enable the user to extend the life of the blade many times over.

The rotary cutter tool has been on the market for many years and is used for the cutting of fabric material used by quiltmakers and seamstresses. Continuous use of the rotary cutter tool results in the cutting blade becoming dull and less able to cut fabric material. Normally the blade had to be replaced because no apparatus existed to sharpen the cutting blade. Thus, a need existed for an apparatus for sharpening the cutting blade of a rotary cutter tool to avoid having to replace the cutting blade when it became dull.

In my pending U.S. application Ser. No. 08/344,877, I disclose an apparatus for sharpening the circular cutting blade of a rotary cutter tool which provides first and second members for holding the cutting blade stationary with a ring member positioned above the second member having an angulated portion with an abrasive strip fixedly attached thereto. A central, threaded shank portion extends upward through the first member, cutting blade, second member, and ring member, thereby allowing the ring member to rotate relative to the cutting blade. The ring member is positioned above the second member such that the abrasive strip contacts the edge of the cutting blade. When the ring member is rotated relative to the cutting blade, the abrasive strip on the ring member rubs against the edge of the cutting blade, thereby removing nicks and burrs from the cutting blade and sharpening the cutting blade.

A first alternate embodiment of the above-described apparatus is also disclosed which provides first and second or male and female members in the form of a two-part circular box for securing and sharpening the cutting blade. The first or male member has a base portion with a central hub extending upward from the base portion and a hub spline or key on the longitudinal side of the central hub for holding the cutting blade stationary. The second or female member has a base portion with an angulated portion mounted on the base portion and a cavity extending through the center of the angulated portion and base portion for receiving the hub portion and hub spline or key. The angulated portion has an abrasive strip fixedly attached. The cutting blade is positioned on the hub of the male member. The female member is positioned over the cutting blade such that the hub and hub spline or key engage the cavity and the abrasive strip contacts the edge of the cutting blade. The male and female members are rotated relative to each other such that the abrasive strip abrades or rubs against the edge of the cutting blade, removing nicks and burrs from the cutting blade and thereby sharpening the cutting blade.

A need exists for a hand-held apparatus for sharpening a circular cutting blade of a rotary cutter tool which provides a blade holder with first or male and second or female members for securing the cutting blade and means for sharpening the cutting blade wherein the sharpening means includes a pair of abrasive strips, one strip containing a finer abrasive than the other strip, to further sharpen the cutting blade.

A need also exists for a hand-held apparatus for sharpening a circular cutting blade of a rotary cutter tool which provides a handle portion on the male and female members of the blade holder to facilitate the rotation of the cutting blade relative to the abrasive strip, thereby improving the abrading and sharpening of the cutting blade.

A need also exists for a hand-held apparatus for sharpening a circular cutting blade of a rotary cutter tool which is simple in design and easy and economical to manufacture.

SUMMARY OF THE PRESENT INVENTION

The invention is a tool comprised of an upper component carrying an abrasive strip at a certain angle inside, a clamp for the purpose of holding the blade stationary against a lower platform which has a shank running up through it for positioning the several components.

When the components are assembled, the upper component brings the abrasive strip down against the blade edge being held by the clamp against the lower component or platform. A simple twisting or rotating of the upper component against the lower assembly causes the abrasive strip to act on the blade edge, sharpening it.

A compact tool especially designed to sharpen the cutting edge of a rotary cutter blade, consisting of a shanked platform onto which to place a cutter blade, a threaded clamp thereupon screwed down the shank to restrain the blade from rotating when an upper casing, containing an abrasive strip placed at a certain angle inside the upper casing, is placed over the shank and lowered into contact with the clamp and rotated in a clockwise and counterclockwise motion, said motion causing the abrasive strip to act upon the cutting edge of the blade and sharpening it.

The alternate embodiment comprises a rotary cutter blade sharpener tool comprised of an inner and an outer casing which form a two-part circular box, the inner casing of which contains a keyed hub on a platform upon which a rotary cutter blade is placed, the hub key restraining the blade from rotating; when the outer casing is fitted over and around the inner casing, thus bringing an abrasive strip affixed at a certain angle on a platform inside the outer casing into juxtaposition with the blade, the abrasive strip acts on the cutting edge of the rotary blade when the outer casing is rotated in clockwise and counterclockwise fashion around the inner casing, with the process being repeated when the box is disassembled and the blade turned over to sharpen the opposite of the blade edge.

The second alternate or most preferred embodiment of the apparatus of the present invention solves the aforementioned problems in a straightforward and simple manner. What is provided is this most preferred apparatus designed to sharpen the circular cutting blade of a so-called rotary cutter, a hand-held device used to cut fabric. The circular cutting blade is also used in certain paper-cutting devices. The circular cutting blade has a central notched substantially circular aperture and an outer edge.

The most preferred embodiment of the apparatus of the present invention is generally comprised of a blade holder for holding the cutting blade stationary and means for sharpening the outer edge of the circular cutting blade. The blade holder comprises first or male and second or female members each having base portions for engaging the cutting blade. The base portions have top, bottom and longitudinal sides. The first member has a means for fastening the top side of the base portion of the first member to the bottom side of the base portion of the second member. The fastening means extends upward from the center of the top side of the base portion such that the cutting blade is held stationary between the first and second members relative to the blade holder. The second member has a cavity in the center of the bottom side of its base portion for receiving the fastening means of the first member. The sharpening means contacts the edge of the cutting blade when the cutting blade is held stationary between the first and second members.

In the operation of the most preferred, the circular cutting blade is positioned on the top side of the base portion of the first member such that the fastening means extends through the central aperture in the cutting blade. The second member is then positioned on the cutting blade such that the cavity of the second member engages the fastening means of the first member, thereby securing the top side of the base portion of the first member to the bottom side of the base portion of the second member and holding the cutting blade stationary between the first and second members. The sharpening means is positioned such that it contacts the side of the edge of the cutting blade opposite the base portion of the first member in the blade holder. The blade holder is rotated clockwise and counter-clockwise with respect to the sharpening means such that the sharpening means abrades the edge of the cutting blade, thereby removing nicks and burrs from the cutting blade and sharpening the cutting blade.

In view of the above, it is an object of the present invention to provide a hand-held apparatus for sharpening a circular cutting blade of a rotary cutting tool which provides a blade holder with male and female members for securing the cutting blade and means for sharpening the cutting blade wherein the sharpening means includes a pair of abrasive strips, one strip containing a finer abrasive than the other strip, to further sharpen the cutting blade.

In view of the above objects it is a feature of the present invention to provide a hand-held apparatus for sharpening a circular cutting blade of a rotary cutter tool which provides a handle portion on the male and female members of the blade holder to facilitate the rotation of the cutting blade relative to the abrasive strip, thereby improving the abrading and sharpening of the cutting blade.

It is another feature of the present invention to provide an apparatus for sharpening a circular cutting blade of a rotary cutter tool which is simple in design and easy and economical to manufacture.

BRIEF DESCRIPTION OF THE DRAWING

For a further understanding of the nature and objects of the present invention, reference should be had to the following description taken in conjunction with the accompanying drawing in which like parts are given like reference numerals and, wherein:

FIG. 2 is a cross-sectional view of the embodiment of FIG. 1 in a slightly opened position;

FIG. 3 is a top plan view of the embodiment of FIG. 1;

FIG. 8 is a side view of the female member of the blade holder of FIGS. 6 and 7, with the cavity in the female member shown in phantom;

FIG. 9 is a side view of the male member of the blade holder of FIGS. 6 and 7;

FIG. 10 is a bottom view of the male member of FIG. 9 illustrating the cross-sectional shape of the base portion and how the handle portion is mounted on the base portion;

FIG. 11 is a side view of the male member of FIG. 9 rotated 90° and inverted, further illustrating how the handle portion and the fastening means are mounted on the base portion;

FIG. 12 is a cross-sectional side view of the female member of FIG. 8 rotated 90° and inverted, further illustrating the cavity as it extends into the base portion;

FIG. 13 is a bottom view of the female member of FIG. 8, illustrating the cross-sectional shape of the base portion and the cavity in the base portion, with the handle portion shown in phantom;

DETAILED DESCRIPTION OF THE PREFERRED AND ALTERNATE EMBODIMENTS

Figure 1:
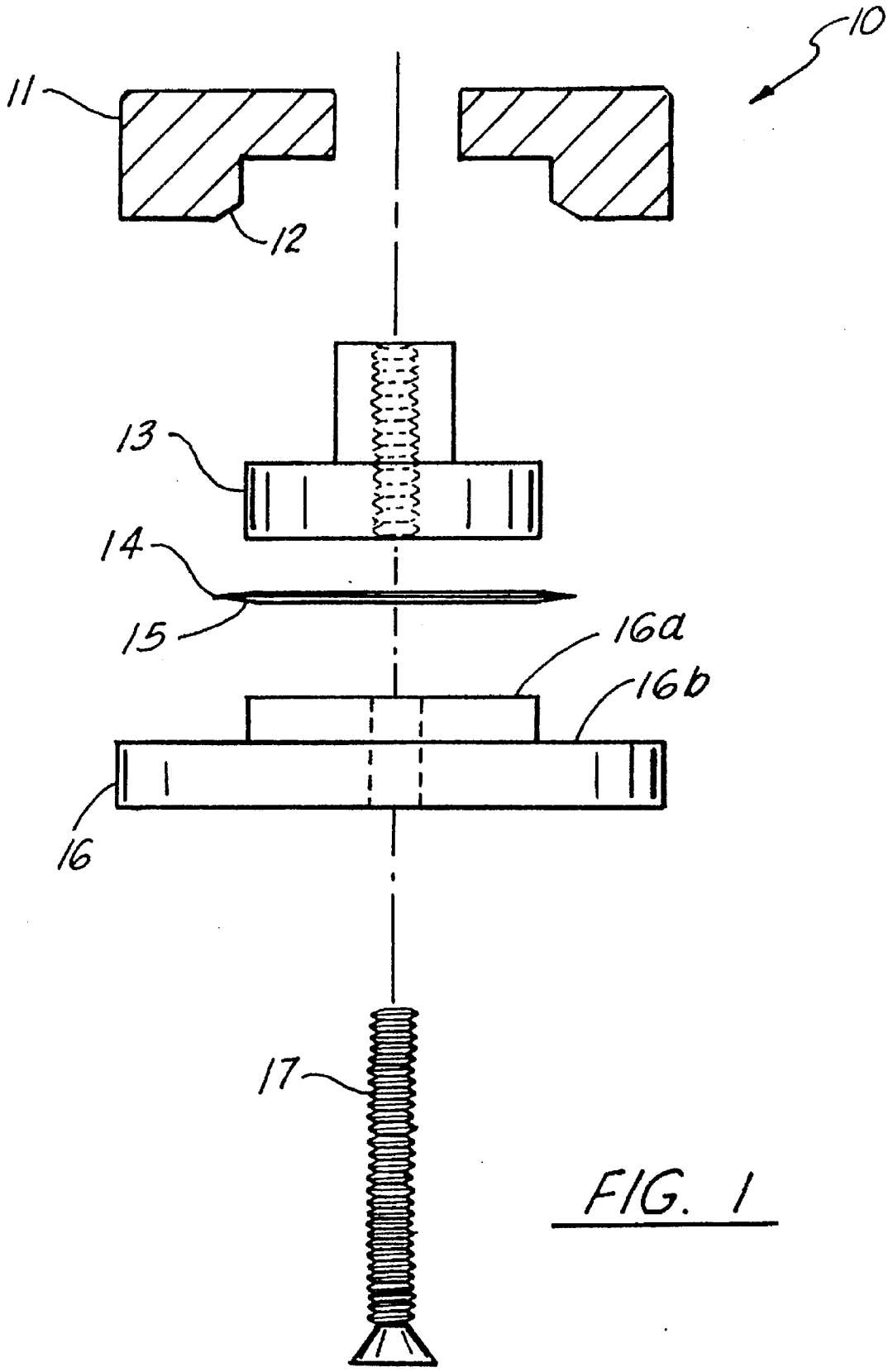
FIG. 1 is an exploded cross-sectional view of the preferred embodiment of the apparatus of the present invention.

FIG. 1 shows the tool 10 in exploded view with the numbered components identified as follows:

11 The round Upper Casing having

12 Abrasive bonded to an inner angled surface.

13 Inside-threaded Clamp.

14 Rotary Cutter Blade Cutting Edge

15 Rotary Cutter Blade.

16 Platform:

**16*a*** Smaller surface

**16*b*** Larger surface.

17 Central threaded Shank.

FIG. 2 is the tool 10 shown in slightly opened position. Screwing down clamp 13 on shank 17 binds blade 15 against platform **16*a*. Upper casing 11 is then placed over clamp 13 until abrasive 12 contacts blade edge 14. Rotation of upper casing 11 causes abrasive 12 to act on blade edge 14, sharpening said edge 14**.

Platform 16 has an outside-threaded shank 17 attached vertically through its center, shank 17 being of sufficient length to accommodate the total height of the various components when the tool is assembled over shank 17, said shank 17 being approximately the diameter of the central positioning hole of rotary cutter blade 15.

The first step is to place blade 15 over shank 17 until blade 15 is resting on the smaller surface **16*a* of platform 16**.

The inside-threaded clamp 13 is then screwed down shank 17 tightly onto blade 15, restraining blade 15 from turning.

Upper casing 11, having a central hole of such dimension as to allow it to be placed over clamp 13, is then lowered over clamp 13 and pressed down until abrasive 12 comes into contact with blade edge 14.

The lower surface of casing 11 is in this position almost touching the upper surface **16*b* of platform 16, preventing the lower surface of casing 11 from causing blade edge 14** to bend and possibly break.

Upper casing 11 is then rotated in clockwise and counter-clockwise motion around clamp 13, this motion causing the abrasive 12 to act upon blade edge 14 thereby sharpening it.

Upper casing 11 is then removed, clamp 13 unscrewed and removed, blade 15 turned over and the process repeated, resulting in blade edge 14 being sharpened on both sides.

An alternate embodiment 50 of the tool of the present invention is presented which differs from the above preferred embodiment 10 of the tool in that the blade is held in place by different means.

This embodiment of the tool of the present invention is also used to sharpen rotary cutter blades and is comprised of two cup-shaped casings, one containing an abrasive strip to sharpen the blade edge and the other being a receptacle for holding the blade. When the two are juxtaposed, a simple twisting or rotating of the one on the other causes the abrasive strip to act on the blade edge, sharpening it.

Figure 4:
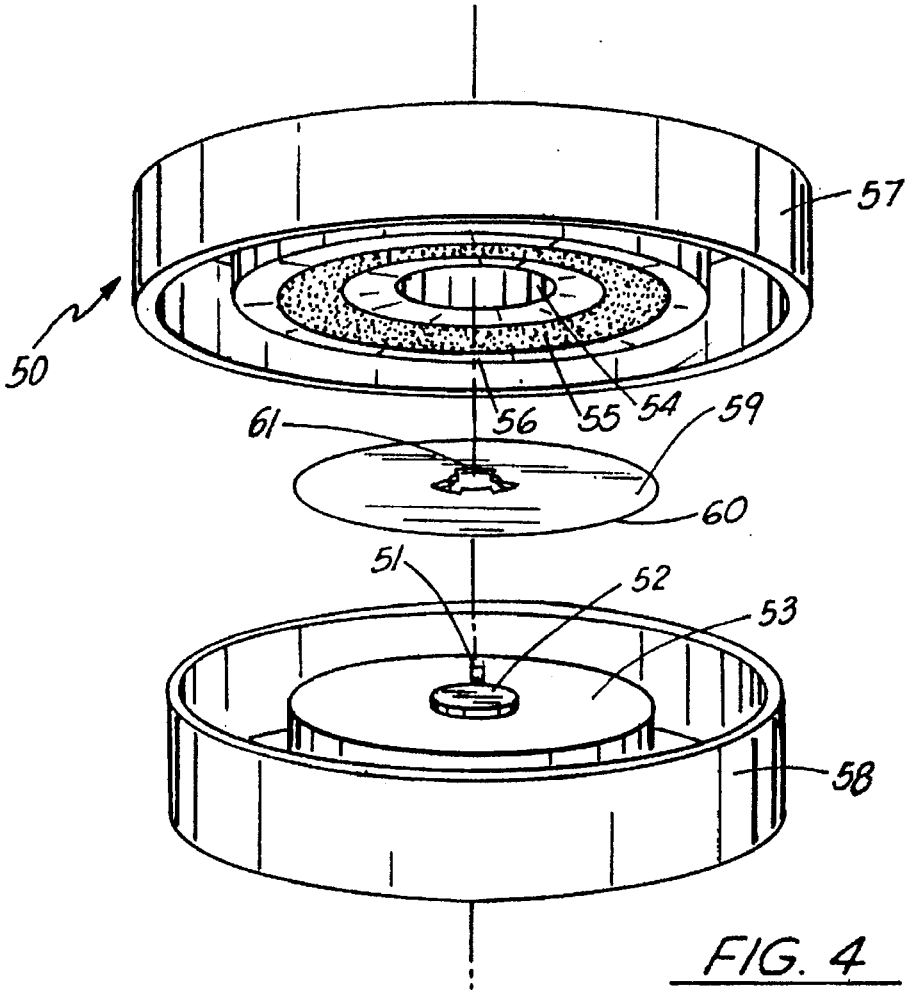
FIG. 4 is an exploded perspective view of an alternate (first alternate) embodiment of the apparatus of the present invention.
Figure 5:
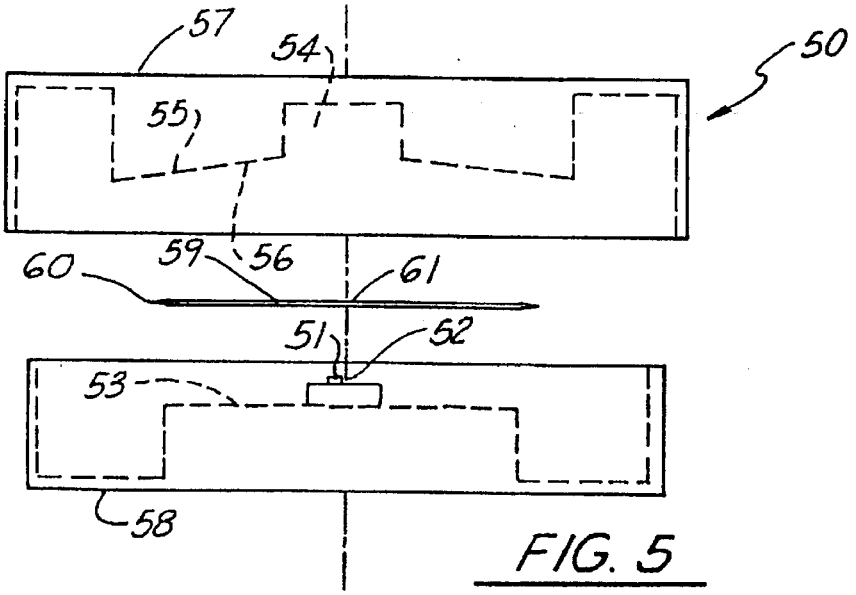
FIG. 5 is an exploded front view of the embodiment of FIG. 4.
Figure 6:
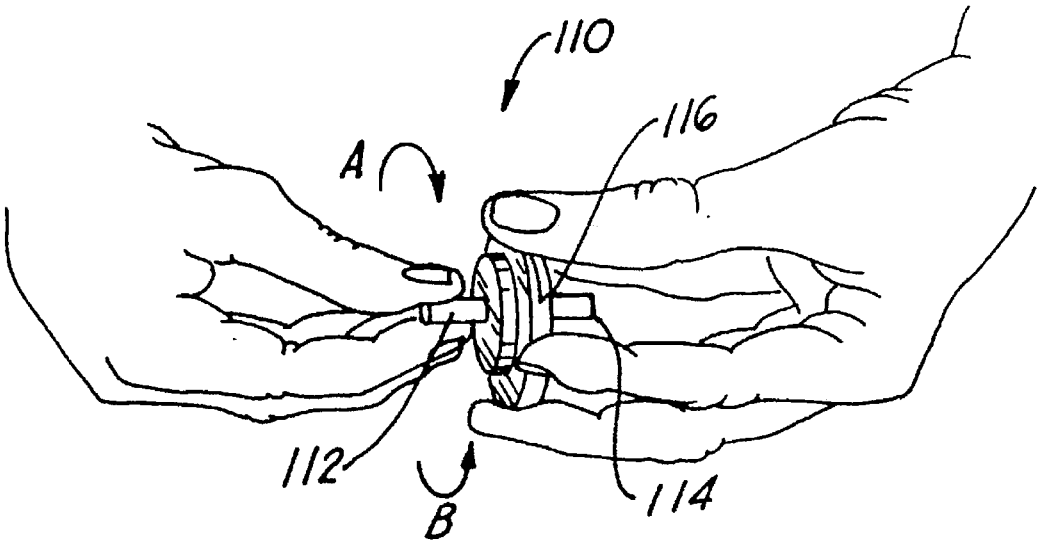
FIG. 6 is a perspective view illustrating the operation of the second alternate (and most preferred) embodiment of the apparatus of the present invention, including the rotational motion of the blade holder used to sharpen the blade.

Alternate embodiment components:

FIGS. 4 and 5 show the elements as follows:

51 The Hub Key

52 The Hub

53 The Hub Platform

54 Cavity for Hub insertion

55 Abrasive Strip

56 Upper Platform carrying Abrasive Strip

57 Upper Casing

58 Lower Casing

59 Rotary Cutter Blade

60 Rotary Cutter Blade Edge

61 Blade centering hole with slots

A dulled blade 59 is placed over hub 52 on platform 53 in the inner casing 58 so that hub key S1 protrudes through one of the slots 61 of the blade centering hole, restraining blade 59 from rotating.

Outer casing 57, being of slightly larger circumference than inner casing 58, is fitted around casing 58, forming a closed, circular two-part box.

In this position, abrasive strip 55, affixed at a certain angle on platform 56 inside casing 57, comes into contact with blade edge 60 of blade 59 on the hub platform 53 inside inner casing 58.

By rotating outer casing 57 clockwise and anti-clockwise around inner casing 58, abrasive strip 55 acts on blade edge 60, sharpening said edge.

Outer casing 57 can then be removed from inner casing 58, blade 59 removed and turned over, replaced onto keyed hub 52 on platform 53, and the process repeated, thus sharpening both sides of blade edge 60.

Figure 7:
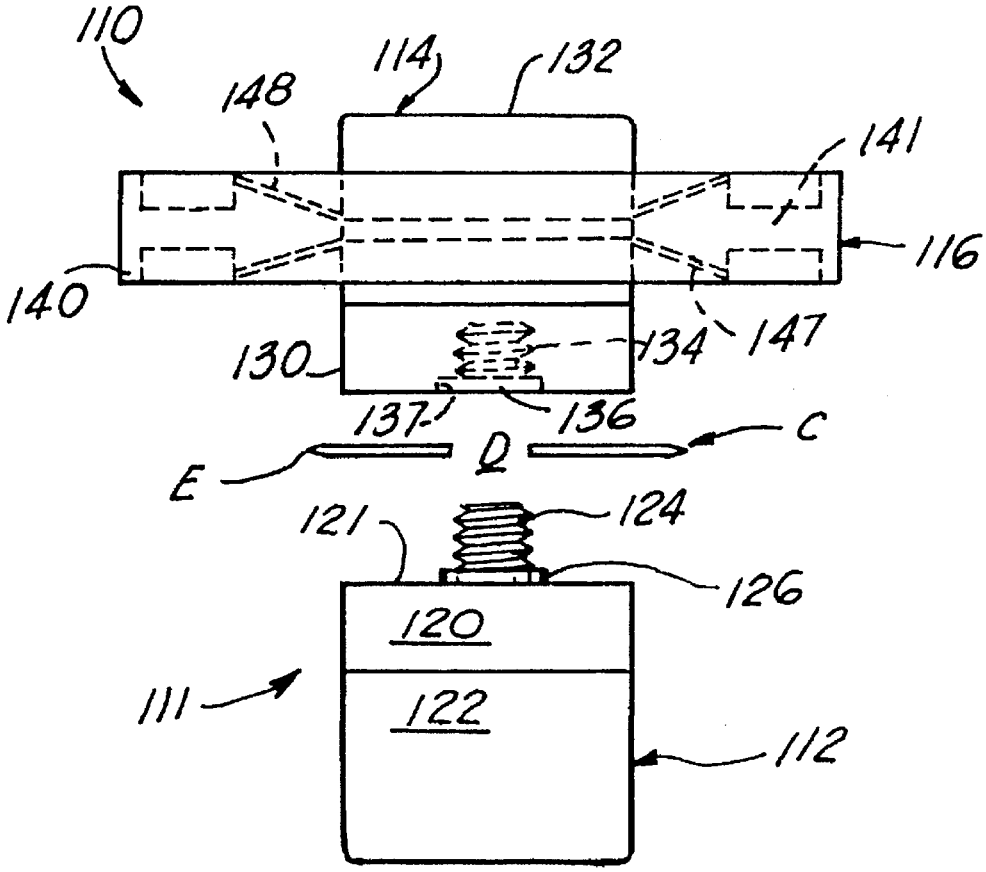
FIG. 7 is a exploded side view of the embodiment of FIG. 6.

Referring to the drawing, and FIGS. 6–15 in particular, the second alternate or most preferred embodiment of the apparatus of the present invention is designated generally by the numeral 110. Hand-held apparatus 110 is designed to operate on circular cutting blade C of a rotary cutter tool having central substantially circular notched aperture D and outer edge E. Apparatus 110 is generally comprised of blade holder 111 for holding circular cutting blade C stationary and ring member 116 which fits around blade holder 111 and contacts one side of edge E of cutting blade C, as best seen in FIG. 7.

Blade holder 111 is comprised of first or male member 112 and second or female member 114, as seen in FIG. 7. Male member 112 includes base portion 120, handle portion 122, and threaded projection or screw 124, as best seen in FIGS. 9–11. Base portion 120 is cylindrical in shape with a circular cross-section, as seen in FIGS. 9 and 10, and has platform or top surface 121, bottom side 123 and longitudinal side 125, as seen in FIGS. 9 and 11. The diameter of base portion 120 is smaller than the diameter of cutting blade C. Handle portion 122 is rectangular in shape and is mounted perpendicularly on bottom side 123 of base portion 120. The handle portion 122 does not pass through the center of bottom side 123, as seen in FIGS. 10 and 11. Screw 124 is mounted in base portion 120 and extends perpendicular from the center of platform 121, as seen in FIGS. 9 and 11. Platform 121 has an annular shoulder portion 126 at its junction with screw 124 which is inserted into circular recess 136. Shoulder portion 126 holds blade C stationary and prevents it from eroding the threads. Base portion 120 and handle portion 122 are preferably made of a moldable plastic material.

Figure 14:
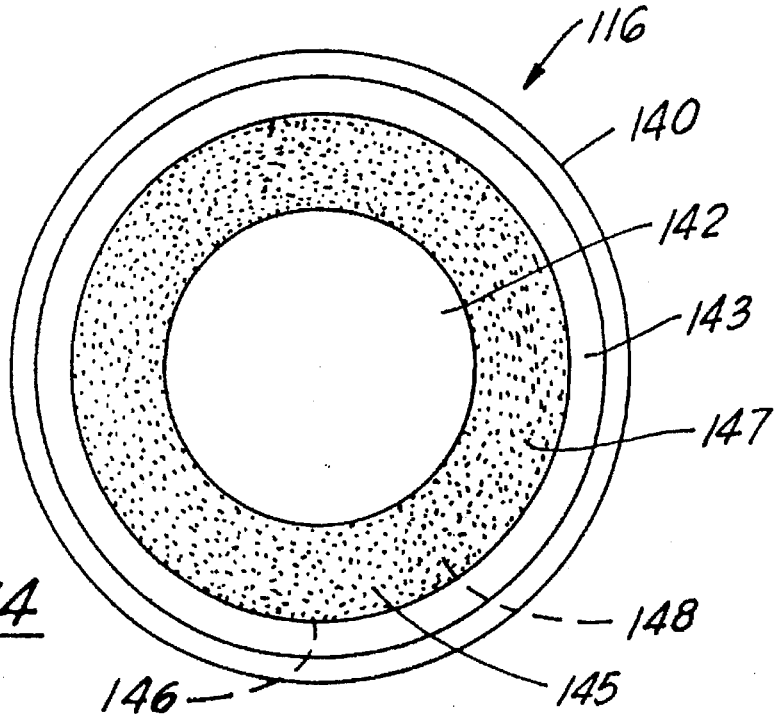
FIG. 14 is a top radial view of the ring member of FIGS. 6 and 7, illustrating the positioning of the abrasive strip on the ring member.

Female member 114 includes a base portion 130, handle portion 132, and threaded cylindrical cavity 134, as best seen in FIGS. 7, 8, 12 and 13. Base portion 130 is cylindrical in shape with a circular cross-section, as seen in FIGS. 8 and 13, and has top side or surface or platform 133, bottom side or surface or platform 131 and longitudinal side 135, as seen in FIG. 8. The diameter of base portion 130 is smaller than the diameter of cutting blade C. Base portion 130 also has threaded cylindrical cavity 134 extending into the center of bottom side or platform 131 for receiving screw 124 of male member 112, as seen in FIGS. 8, 12 and 13. Cavity 134 has circular recess 136 around its opening 137 to accept shoulder portion 126 at the base of screw 124, as best seen in FIGS. 8 and 14. Handle portion 132 is rectangular in shape and is mounted perpendicularly on top side 133 of base portion 130. Handle portion 132 does not pass through the center of top side 133, as seen in FIGS. 8 and 13. Base portion 130 and handle portion 132 are preferably made of a moldable plastic material.

Figure 15:
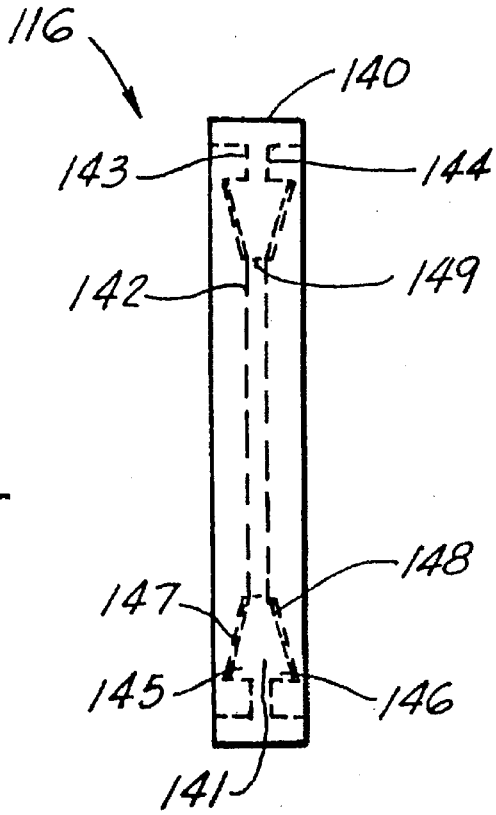
FIG. 15 is a partial cross-sectional side view of the ring member of FIG. 14, illustrating the positioning of the angulated portions and the abrasive strips on the ring member in phantom.

Ring member 116 has a circular aperture 142 inside radial portion 141, as best seen in FIGS. 14 and 15. Radial portion 141 has top side 143, bottom side 144, longitudinal side 149 and central circular aperture 142 for receiving blade holder 111. The diameter of aperture 142 is slightly larger than the diameter of base portions 120 and 130, respectively, of male and female members 112 and 114, respectively, but smaller than the diameter of cutting blade C. Angulated portions 145 and 146 extend from top side 143 and bottom side 144, respectively, and adjacent aperture 142, as best seen in FIG. 15. Abrasive strips 147 and 148 are fixedly attached to angulated portions 145 and 146, respectively, as best seen in FIG. 15. Abrasive strip 147 contains a coarse abrasive, and abrasive strip 148 contains a fine abrasive for further sharpening edge E of cutting blade C. The reverse arrangement works equally well, the only requirement being that one abrasive strip should have a finer abrasive than the other abrasive strip. The entire ring 116 (including vertical portion 140, radial portion 141 and angulated portions 145 and 146, etc.), except for abrasive strips 147 and 148, is preferably made in one piece of a moldable plastic material.

Referring again to FIGS. 6 and 7, the operation of the second alternate or most preferred embodiment of the apparatus of the present invention is illustrated. Circular cutting blade C of a rotary cutter tool is positioned on top side or platform 121 of base portion 120 of male member 112 such that screw 124 extends through circular aperture D of cutting blade C. Female member 114 is positioned on top of cutting blade C such that cavity 134 of female member 114 engages screw 124 of male member 112. Female member 114 and male member 112 are then rotated in opposite directions (ARROWS A and B of FIG. 6) such that screw 124 threadably advances inside cavity 134 and bottom side 131 of base portion 130 of female member 114 and top side 121 of base portion 120 of male member 112 hold cutting blade C stationary relative to themselves and with annular shoulder 126 thereby seated in recess 136. Male member 112 and female member 114 secured together, with cutting blade C held stationary between them, form blade holder 111.

Female member 114 of blade holder 111 is then inserted through aperture 142 of ring member 116 such that elongated or longitudinal side 135 of base portion 130 of female member 114 engages longitudinal side 149 of radial portion 141 of ring member 116, whereby the side of edge E of cutting blade C opposite male member 112 contacts coarse abrasive strip 147. Handle portion 122 of male member 112 is then rotated clockwise and counter-clockwise, as indicated by ARROWS A and B in FIG. 6, thereby abrading the side of edge E against coarse abrasive strip 147. The abrading action of coarse abrasive strip 147 against the side of edge E removes nicks and burrs from that side of edge E and sharpens that side of edge E. After a sufficient number of rotations of cutting blade C relative to ring member 116 to sharpen edge E, blade holder 111 is removed from ring member 116 and ring member 116 is inverted. Female portion 114 is then inserted into aperture 142 of ring member 116 such that longitudinal side 135 of base portion 130 of female member 114 again engages longitudinal side 149 of radial portion 141 and fine abrasive strip 148 contacts the same side of edge E. Handle portion 122 is rotated clockwise and counter-clockwise relative to ring member 116 until fine abrasive strip 148 further sharpens the same side of edge E. Because fine abrasive strip 148 contains a finer abrasive than coarse abrasive strip 147, fine abrasive strip 148 sharpens the side of edge E of cutting blade C better than simply continued abrading of coarse abrasive strip 147 against the side of edge E.

To sharpen the opposite side of edge E of cutting blade C, blade holder 111 is removed from ring member 116 and both are inverted. Male member 112 of blade holder 111 is then inserted into ring member 116 until longitudinal side 125 of base portion 120 of male member 112 engages longitudinal side 149 of radial portion 141 and the opposite side of edge E, that is, the side of edge E adjacent male member 112, contacts coarse abrasive strip 147. Handle portion 132 of female member 114 is then rotated clockwise and counter-clockwise relative to ring member 116 such that coarse abrasive strip 147 abrades against the opposite side of edge E, removing nicks and burrs and sharpening the opposite side of edge E. Blade holder 111 is then removed from ring member 116, and ring member 116 is inverted. Male member 112 of blade holder 111 is then inserted into ring member 116 such that longitudinal side 125 of base portion 120 of male member 112 again contacts longitudinal side 149 of radial portion 141 and the opposite side of edge E contacts fine abrasive strip 148. Handle portion 132 of female portion 114 is then rotated clockwise and counter-clockwise relative to ring member 116 until fine abrasive strip 148 abrades the opposite side of edge E, thereby further sharpening the opposite side of edge E.

After a sufficient number of rotations of cutting blade C relative to ring member 116 to sharpen edge E, blade holder 111 is removed from ring member 116. Male member 112 and female member 114 are then rotated in opposite directions such that screw 124 exits cavity 134 and male member 112 detaches from female member 114. The now-sharpened cutting blade C is then removed from male member 112 and replaced in the rotary cutter tool from which cutting blade C was removed. Cutting blade C is now ready for use.

Figure 16:
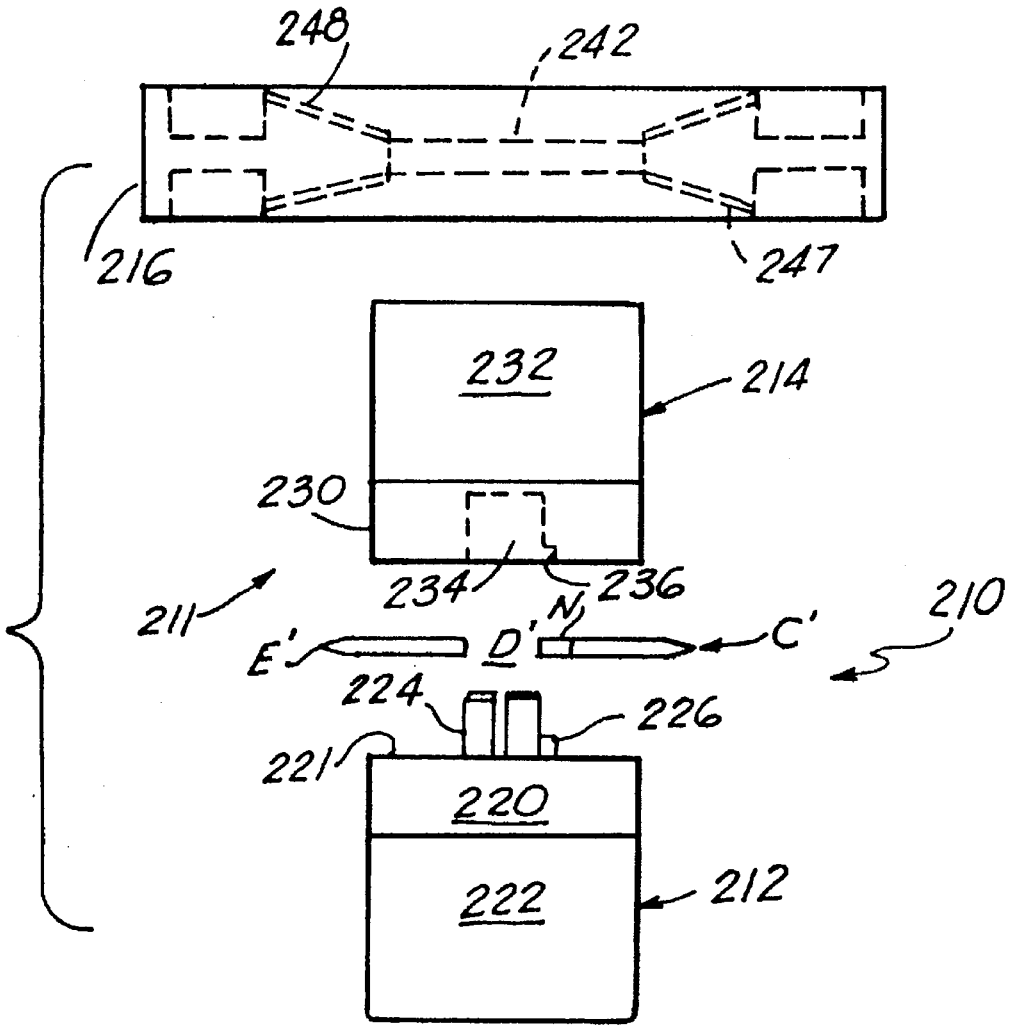
FIG. 16 is an exploded side view of the third alternate embodiment of the apparatus of the present invention.

Referring to FIGS. 16–21, and FIG. 16 in particular, yet another or third alternate embodiment of the apparatus of the present invention is designated generally by the numeral 210. Apparatus 210 differs from apparatus 110 in having shank portion 224 instead of screw 124 and notched cavity 234 instead of threaded cavity 134. Apparatus 210 generally comprises blade holder 211 for holding circular cutting blade C stationary and ring member 216 which fits around blade holder 211 and contacts edge E of cutting blade C, as best seen in FIG. 16.

Figure 17:
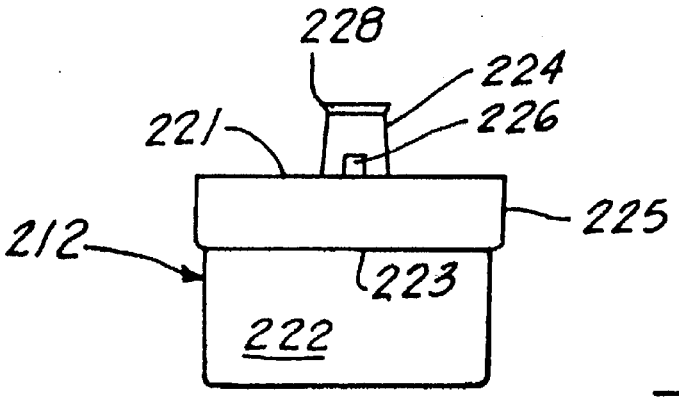
FIG. 17 is a side view of the male member of the embodiment of FIG. 16, illustrating the fastening means of this third alternate embodiment.
Figure 18:
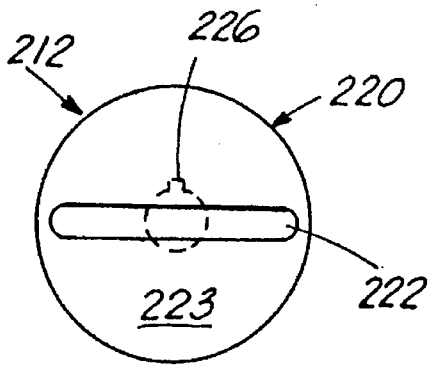
FIG. 18 is a bottom view of the male member of FIG. 17, illustrating the cross-sectional shape of the base portion and how the handle portion is mounted on the base portion.
Figure 19:
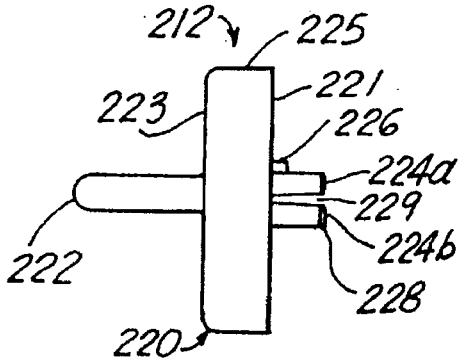
FIG. 19 is a side view of the male member of FIG. 17 rotated 90° along the vertical and horizontal axes extending through the center of the male member, further illustrating the fastening means and how the handle portion is mounted on the base portion.

Blade holder 211 is comprised of male member 212 and female member 214, as seen in FIG. 16. Male member 212 includes base portion 220, handle portion 222, and shank portion 224, as best seen in FIGS. 17–19. Base portion 220 is cylindrical in shape with a circular cross-section and has top side or platform 221, bottom side 223 and longitudinal side 225, as seen in FIGS. 17 and 18. The diameter of base portion 220 is smaller than the diameter of cutting blade C'. Handle portion 222 is rectangular in shape and is mounted perpendicularly on bottom side 223 of base portion 220. Handle portion 222 does not pass through the center of bottom side 223, as seen in FIGS. 18 and 19. Shank portion 224 has slightly tapered end 228, as seen in FIGS. 17 and 19. Shank portion 224 comprises two semi-cylindrical shank portions **224*a* and 224*b* with aperture 229 between them, as best seen in FIG. 19. Semi-cylindrical shank portion 224*a* has spline or notch 226 extending on its longitudinal side and downwards to top side or platform 221 of base portion 220. Shank portion 224 is mounted in the center of top side 221 of base portion 220, as seen in FIGS. 17 and 19. Base portion 220, handle portion 222 and shank portion 224** are preferably made of a moldable plastic material.

Figure 20:
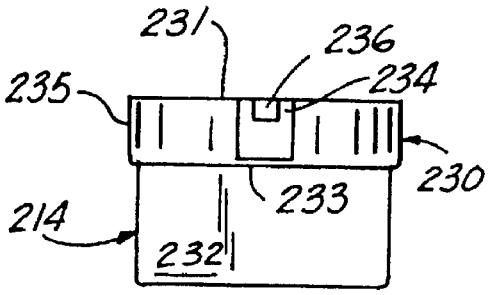
FIG. 20 is an inverted side view of the female member of the alternate embodiment of FIG. 16, illustrating the cavity of the embodiment.
Figure 21:
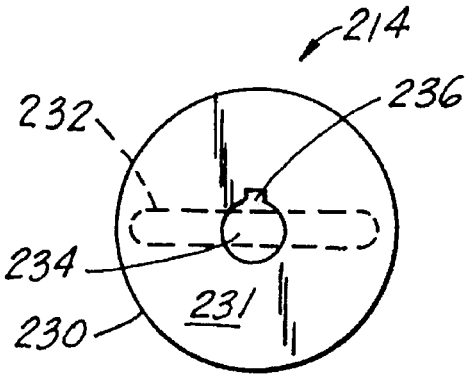
FIG. 21 is a bottom view of the female member of FIG. 20, illustrating the cross-sectional shape of the base portion and the cavity in the base portion of the female member, with the handle portion shown in phantom.
Figure 22:
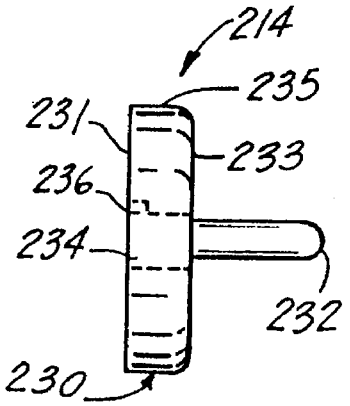
FIG. 22 is a side view of the female member of FIG. 20 rotated 90° along the vertical and horizontal axes extending through the center of the female member, further illustrating the cavity, shown in phantom, and handle portion mounted on the base portion.

Female member 214 includes base portion 230, handle portion 232, and cavity 234 with slot 236 therein, as best seen in FIGS. 20–22. Base portion 230 is cylindrical in shape with a circular cross-section, as seen in FIGS. 20 and 21, and has top side 233, bottom side 231 and longitudinal side 235, as seen in FIGS. 20 and 22. The diameter of base portion 230 is smaller than the diameter of cutting blade C'. Base portion 230 also has cylindrical cavity 234 extending into the center of bottom side 231 for receiving shank portion 224 of male member 212. Cavity 234 has slot 236 extending from bottom side 231, as seen in FIGS. 21 and 22. Handle portion 232 is rectangular in shape and is mounted perpendicularly on top side 233 of base portion 230. Handle portion 232 does not pass through the center of top side 233, as seen in FIGS. 21 and 22. Base portion 230 and handle portion 232 are preferably made of a moldable plastic material.

Ring member 216 is similar to ring member 116 in all respects, as seen in FIG. 16.

The operation of apparatus 210 is similar to the operation of apparatus 110, except in the following respects. Circular cutting blade C' has central aperture A' with notched recess N. The cross-section of aperture A' is similar to that of slotted cavity 234 of female member 214. Cutting blade C' is positioned on top side 221 of base portion 220 of male member 212 such that shank portion 224 extends through aperture A'. Spline or notch 226 of shank portion 224 fits through notched recess N of aperture A' to hold cutting blade C' stationary relative to blade holder 112. Female member 214 is then positioned on cutting blade C' such that shank portion 224 engages cavity 234 of female member 214. Shank portion 224 is inserted into cavity 234 such that spline 226 enters slot 236, thereby securing cutting blade C' between them (spline 226 prevents blade C' from turning, it does not secure male and female members 212, 214 together). To detach male member 212 from female member 214, the members are simply pulled apart.

As can be seen from the above drawing and description, the embodiments of the apparatus of the present invention are simple in design, requiring only a few parts. Furthermore, the apparatus is conveniently made from inexpensive materials, thus being easy and economical to manufacture.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A hand-held abrasive tool for holding a circular cutting blade along a central axis of the tool and sharpening a cutting edge of said circular cutting blade comprising a platform having a threaded shank disposed along the central axis of the tool for receiving said circular cutting blade, a threaded clamp threadably received on the shank to restrain the blade from rotating, an upper circular casing having a circular opening for receiving the shank and an angled abrasive surface strip spaced radially outward and longitudinally along the axis from the opening for engaging the cutting edge of the circular blade when the upper casing is fitted over the threaded clamp wherein the upper casing is rotated in a clockwise and counter-clockwise motion about the central axis of the tool to cause the abrasive strip to sharpen the cutting edge of the blade.

2. A circular cutting blade sharpening tool comprising an inner casing and an outer casing which is larger than the inner casing in order to fit over the inner casing to form a two part circular box, the inner casing having a platform and a keyed hub extending from the platform to support and restrain the circular cutting blade, the outer casing having a platform with a circular angled abrasive surface extending from the platform for engaging and sharpening the edge of the circular blade when the outer casing is fitted over and around the inner casing wherein the circular cutting blade is sharpened when the outer casing is rotated in clockwise and counterclockwise fashion around the inner casing.

3. A hand-held apparatus for sharpening a circular cutting blade of a rotary cutter tool, the cutting blade having an outer edge and a central circular aperture, the apparatus comprising:

(a) a blade holder having first and second members for securing the cutting blade between them such that the cutting blade remains stationary relative to said blade holder, said first and second members each having a base portion with top, bottom and longitudinal sides for engaging the cutting blade, (i) said first member including means for fastening said top side of said base portion of said first member to said bottom side of said base portion of said second member of said second member, said fastening means extending from said top side of said base portion and through the aperture in the cutting blade, and (ii) said second member having a cavity in said bottom side of said base portion for receiving said fastening means; and (b) means for sharpening the cutting blade, said sharpening means contacting the edge of the cutting blade when the cutting blade is secured in said blade holder such that when said blade holder is rotated relative to said sharpening means, said sharpening means abrades the edge of the cutting blade, thereby sharpening the edge of the cutting blade.

4. The apparatus of claim 3, wherein said sharpening means comprises:

(a) a ring member having a vertical portion mounted around a radial portion having a central circular aperture, said radial portion having two radial sides with an angulated portion extending from one of said sides; and (b) an abrasive strip fixedly attached to said angulated portion, said ring member being positioned around said blade holder such that when the cutting blade is secured within said blade holder, said abrasive strip contacts the edge of the cutting blade.

5. The apparatus of claim 4, wherein said ring member has a pair of said angulated portions, each of said angulated portions extending from each of said sides of said radial portion and an abrasive strip fixedly attached to each of said angulated portions, such that both of said sides of said radial portion can sharpen the edge of the cutting blade.

6. The apparatus of claim 5, wherein one of said abrasive strips on said ring member contains a finer abrasive than the other said abrasive strip to further sharpen the edge of the cutting blade.

7. The apparatus of claim 3, wherein:

(a) said fastening means is a screw mounted in the center of said top side of said base portion of said first member; and (b) said cavity is a threaded cavity in the center of said bottom side of said base portion of said second member for receiving said screw such that said screw is rotatably inserted into said threaded cavity to secure said first member to said second member.

8. The apparatus of claim 3, wherein:

(a) said fastening means is a shank portion mounted in the center of said top side of said base portion of said first member with a spline on the longitudinal side of said shank portion extending downwards to said base portion, said spline holding the cutting blade stationary relative to said first member; and (b) said cavity is in the center of said bottom side of said base portion of said second member and includes a slot for receiving said spline on said shank portion such that when said shank portion is inserted into said cavity, said spline engages said slot.

9. The apparatus of claim 3, wherein said first and second members have handle portions mounted perpendicularly on said bottom and top sides, respectively, of said-base portions of said first and second members, respectively, for rotating said blade holder relative to said ring member.

10. A hand-held apparatus for sharpening a circular cutting blade of a rotary cutter tool, the cutting blade having an outer edge and a central circular aperture, the apparatus comprising:

(a) a blade holder having male and female members for securing the cutting blade between them such that the cutting blade remains stationary relative to said blade holder, said male and female members each having a base portion with top, bottom and longitudinal sides for engaging the cutting blade, (i) said male member including means for fastening said top side of said base portion of said male member to said bottom side of said base portion of said female member of said female member, said fastening means being mounted in said top side of said base portion and extending through the aperture in the cutting blade, and (ii) said female member having a cavity in said bottom side of said base portion for receiving said fastening means;

(b) a ring member having a vertical portion mounted around a radial portion having a central circular aperture, said radial portion having two radial sides with an angulated portion extending from one of said sides, said ring member being positioned around said blade holder such that when the cutting blade is secured within said blade holder, said angulated portion contacts the edge of the cutting blade; and (c) means for sharpening the edge of the cutting blade fixedly attached to said angulated portion, said sharpening means contacting the edge of the cutting blade when the cutting blade is secured in said blade holder such that when said blade holder is rotated relative to said sharpening means, said sharpening means abrades the edge of the cutting blade, thereby sharpening the edge of the cutting blade.

11. The apparatus of claim 10, wherein said sharpening means is an abrasive strip.

12. The apparatus of claim 11, wherein said ring member has a pair of said angulated portions, each of said angulated portions extending from each of said sides of said radial portion and an abrasive strip fixedly attached to each of said angulated portions, such that both of said sides of said radial portion may sharpen the edge of the cutting blade.

13. The apparatus of claim 12, wherein one of said abrasive strips on said ring member contains a finer abrasive than the other said abrasive strip to further sharpen the edge of the cutting blade.

14. The apparatus of claim 10, wherein:

(a) said fastening means is a screw mounted in the center of said top side of said base portion of said male member; and (b) said cavity is a threaded cavity in the center of said bottom side of said base portion of said female member for receiving said screw such that said screw is rotatably inserted into said threaded cavity to secure said male member to said female member.

15. The apparatus of claim 10, wherein:

(a) said fastening means is a shank portion mounted in the center of said top side of said base portion of said male member with a spline on the longitudinal side of said shank portion extending downwards to said base portion, said spline holding the cutting blade stationary relative to said male member; and (b) said cavity is in the center of said bottom side of said base portion of said female member and includes a slot for receiving said spline on said shank portion such that when said shank portion is inserted into said cavity, said spline engages said slot.

16. The apparatus of claim 10, wherein said male and female members have handle portions mounted perpendicularly on said bottom and top sides, respectively, of said base portions of said male and female members, respectively, for rotating said blade holder relative to said ring member.

17. A hand-held apparatus for sharpening a circular cutting blade of a rotary cutter tool, the cutting blade having an outer edge and a central circular aperture, the apparatus comprising:

(a) a blade holder having a male member and a female member for securing the cutting blade between them such that the cutting blade remains stationary relative to said blade holder, said male and female members each having a cylindrical base portion with top, bottom and longitudinal sides for engaging the cutting blade and a handle portion mounted perpendicularly on said bottom and top sides, respectively, of said base portions of said male and female members, respectively, for rotating said blade holder, (i) said male member including means for fastening said top side of said base portion of said male member to said bottom side of said base portion of said female member, said fastening means being mounted on said top side of said base portion of said female member and extending through the aperture in the cutting blade, and (ii) said female member having a cavity in said bottom side of said base portion for receiving said fastening means;

(b) a ring member having a vertical portion mounted around a radial portion having a central circular aperture, said radial portion having two radial sides with an angulated portion extending from one of said sides, said ring member being positioned around said blade holder such that when the cutting blade is secured within said blade holder, said angulated portion contacts the edge of the cutting blade; and (c) means for sharpening the edge of the cutting blade fixedly attached to said angulated portion, said sharpening means contacting the edge of the cutting blade when the cutting blade is secured in said blade holder such that when said blade holder is rotated relative to said sharpening means, said sharpening means abrades the edge of the cutting blade, thereby sharpening the edge of the cutting blade.

18. The apparatus of claim 17, wherein said sharpening means is an abrasive strip.

19. The apparatus of claim 18, wherein said ring member has a pair of said angulated portions, each of said angulated portions extending from each of said sides of said radial portion and an abrasive strip fixedly attached to each of said angulated portions, such that both of said sides of said radial portion may sharpen the edge of the cutting blade.

20. The apparatus of claim 19, wherein one of said abrasive strips on said ring member contains a finer abrasive than the other said abrasive strip to further sharpen the edge of the cutting blade.

21. The apparatus of claim 17, wherein:

(a) said fastening means is a screw mounted in the center of said top side of said base portion of said male member; and (b) said cavity is a threaded cavity in the center of said bottom side of said base portion of said female member for receiving said screw such that said screw is rotatably inserted into said threaded cavity to secure said male member to said female member.

22. The apparatus of claim 17, wherein:

(a) said fastening means is a shank portion mounted in the center of said top side of said base portion of said male member with a spline on the longitudinal side of said shank portion extending downwards to said base portion, said spline holding the cutting blade stationary relative to said male member; and, (b) said cavity is in the center of said bottom side of said base portion of said female member and includes a slot for receiving said spline on said shank portion such that when said shank portion is inserted into said cavity, said spline engages said slot.

* * * * *